United States Patent [19]

Landa et al.

[11] Patent Number: 4,627,705

[45] Date of Patent: Dec. 9, 1986

[54] MULTIPLE COLOR LIQUID DEVELOPER ELECTROPHOTOGRAPHIC COPYING MACHINE AND LIQUID DISTRIBUTION SYSTEM THEREFOR

[75] Inventors: Benzion Landa, Alberta, Canada; Josef Rosen, Rehovot, Israel

[73] Assignee: Savin Corporation, Stamford, Conn.

[21] Appl. No.: 628,462

[22] Filed: Jul. 6, 1984

[51] Int. Cl.[4] ..... G03G 15/00

[52] U.S. Cl. ..... 355/4; 355/11; 118/645; 118/659

[58] Field of Search ..... 355/4, 11; 118/645, 118/659

[56] References Cited

U.S. PATENT DOCUMENTS

| | | | |
|---|---|---|---|
| 3,839,071 | 10/1974 | Borelli et al. | 118/645 |
| 3,900,003 | 8/1975 | Sato et al. | 355/10 |
| 3,910,231 | 10/1975 | Inoue et al. | 118/659 |
| 4,110,029 | 8/1978 | Goshima et al. | 355/10 |
| 4,227,797 | 10/1980 | Tsunoi | 118/659 |

FOREIGN PATENT DOCUMENTS

| | | | |
|---|---|---|---|
| 49-12430 | 3/1974 | Japan . | |
| 0040338 | 3/1977 | Japan | 118/659 |
| 0026137 | 3/1978 | Japan | 355/4 |
| 0041414 | 3/1980 | Japan | 118/659 |

*Primary Examiner*—Arthur T. Grimley
*Assistant Examiner*—David Warren
*Attorney, Agent, or Firm*—Shenier & O'Connor

[57] ABSTRACT

An electrophotographic copier for selectively printing in one of a number of different colors in which development takes place at a common station around the periphery of a photoconductive drum to which station a distributor system selectively feeds liquid from one of a number of supply containers and from which the liquid is returned to the container from when it came. Our machine flushes the common portion of the liquid circulating system each time a change in color is made. The processing liquid tanks of our machine are provided with an arrangement for inhibiting settling of toner particles in the tanks.

10 Claims, 7 Drawing Figures

MULTIPLE COLOR LIQUID DEVELOPER ELECTROPHOTOGRAPHIC COPYING MACHINE AND LIQUID DISTRIBUTION SYSTEM THEREFOR

FIELD OF THE INVENTION

Our invention relates to an electrophotographic copying machine and, more particularly, to an electrophotographic copying machine for selectively printing in a number of different colors and to a fluid distribution system for such a copier.

BACKGROUND OF THE INVENTION

There are known in the prior art various electrophotographic copying machines for producing color prints. Most of the prints produced by these machines are panchromatic prints. Various expedients are provided for applying developers of different colors to the photoconductor to produce the color prints. In general, these systems are complicated and cumbersome. They involve the defect that the respective colors from which the print is composed may mingle with each other and become contaminated after a relatively short period of time in use.

SUMMARY OF THE INVENTION

In general, our invention contemplates the provision of an electrophotographic copier for selectively printing in one of a number of different colors in which development takes place at a common station around the periphery of a photoconductor drum to which station a distributor system selectively feeds liquid from one of a number of supply containers and from which liquid is returned to the container from whence it came. Our machine includes means for flushing the common portion of the circulating system both before and after a change of color. Our system incorporates means for inhibiting sedimentation of toner particles in the processing liquid containers.

OBJECTS OF THE INVENTION

One object of our invention is to provide an electrophotographic copier which selectively prints in one of a number of colors.

Another object of our invention is to provide an electrophotographic copier which selectively prints in different colors while avoiding contamination of one color with another.

A further object of our invention is to provide an electrophotographic copier for selectively printing in one of a number of colors which copier is simple in construction and certain in operation.

A still further object of our invention is to provide an electrophotographic copier incorporating a liquid developing system provided with means for inhibiting settling of toner particles in the processing liquid.

Other and further objects of our invention will appear from the following description.

BRIEF DESCRIPTION OF THE DRAWINGS

In the accompanying drawings to which reference is made in the instant specification and which are to be read in conjunction therewith and in which like reference numerals are used to indicate like parts in the various views.

DESCRIPTION OF THE PREFERRED EMBODIMENT

Figure 1:
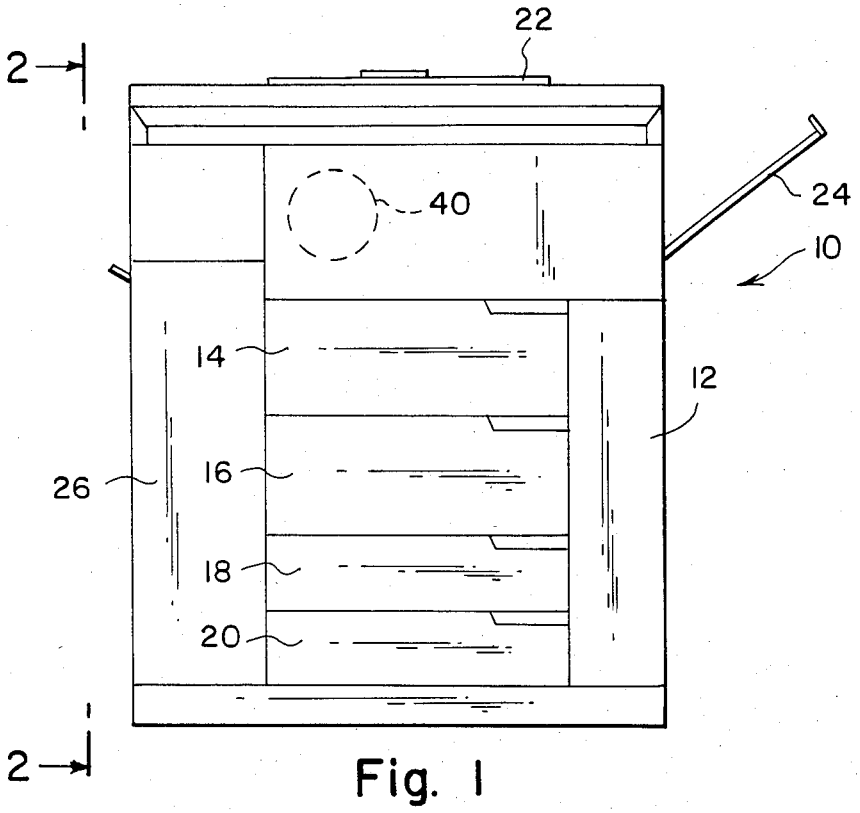
FIG. 1 is a front elevation of our multisource liquid developer electrophotographic copier.
Figure 2:
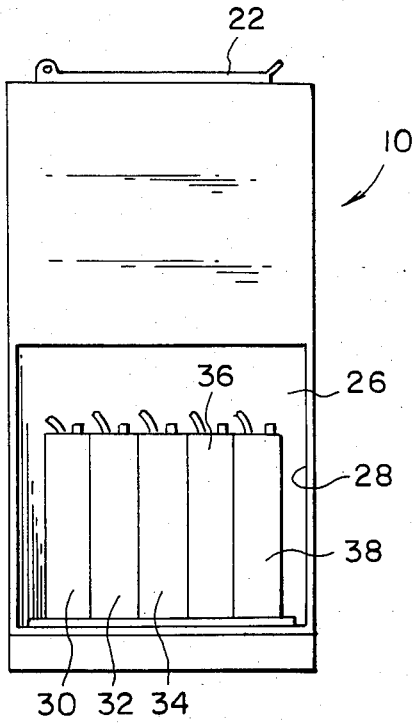
FIG. 2 is a side elevation of the copier shown in FIG. 1 taken along the line 2—2 thereof with a part removed.
Figure 3:
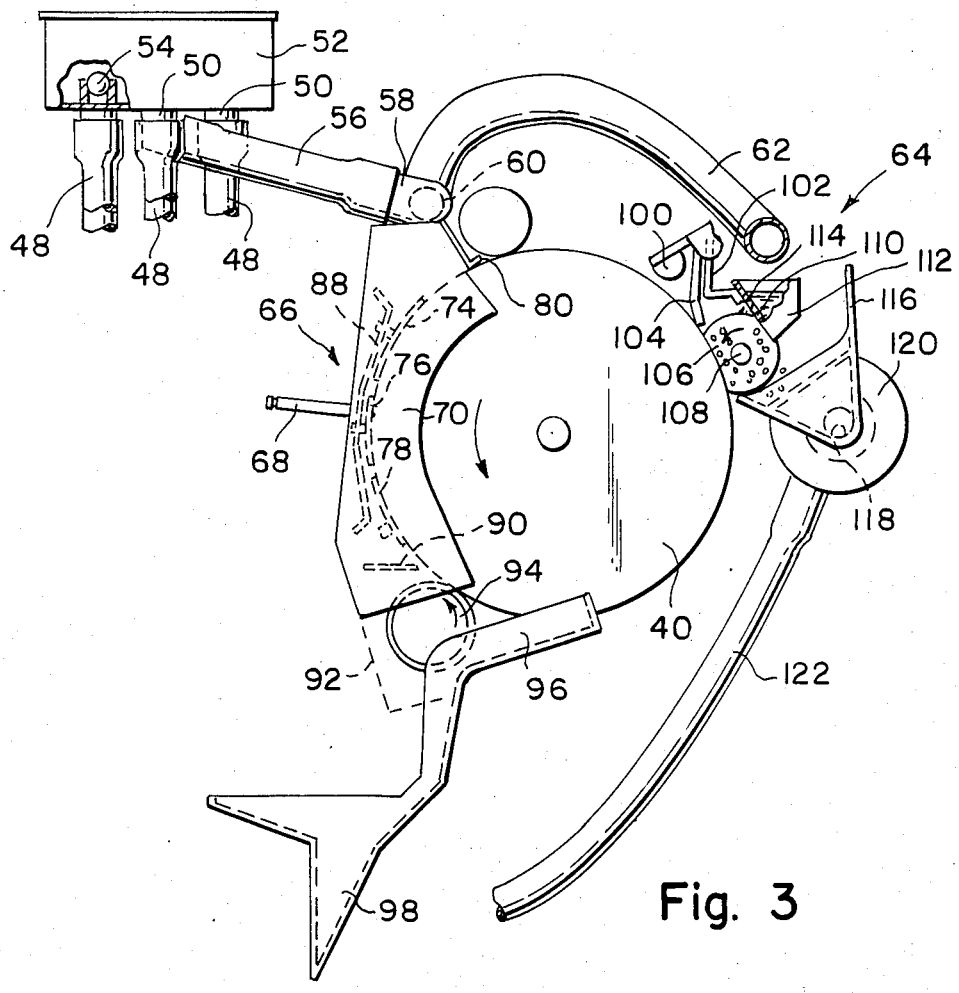
FIG. 3 is a front elevation of a portion of the liquid distribution system of our multisource liquid developer electrophotographic copier.
Figure 4:
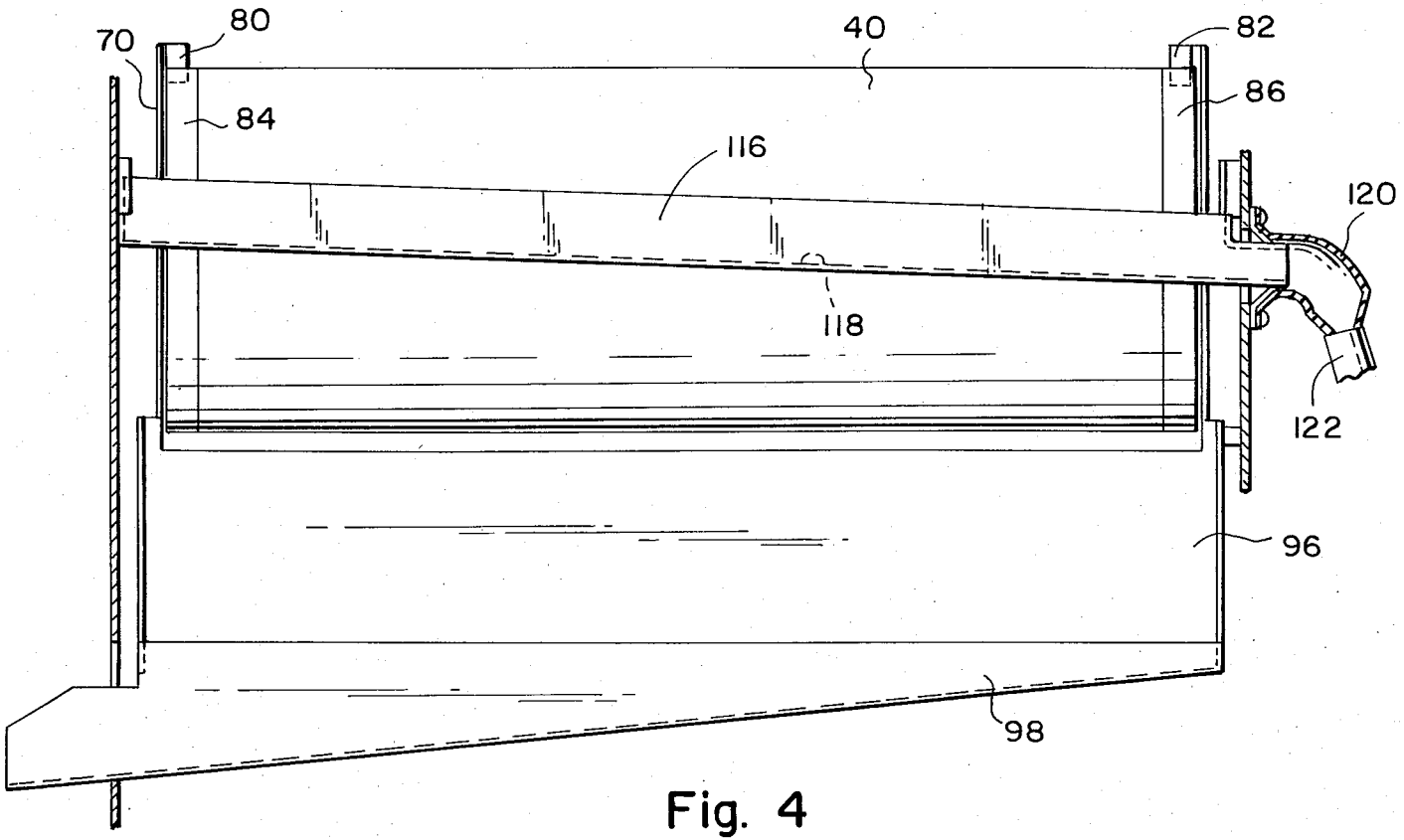
FIG. 4 is an end elevation of the liquid distribution system illustrated in FIG. 3 with parts removed.

Referring now to FIGS. 1 and 2 of the drawings, an electrophotographic copying machine indicated generally by the reference character 10 which incorporates our multisource liquid developer system includes a cabinet 12 which receives a plurality of respective copy paper supply cassettes 14, 16, 18 and 20. The cabinet 12 supports a platen cover 22 which, as is known in the art, normally overlies an original being copied which has been placed on the transparent platen (not shown) in the top of the cabinet 12. A delivery tray 24 supported by the cabinet 12 is adapted to receive a copy made in the manner described hereinbelow.

Cabinet 12 includes a developer liquid supply space 26 located behind an opening 28 in the left side of the cabinet 12. Opening 28 normally is closed by a removable plate (not shown). Supported behind the opening 28 in the space 26 are a plurality of respective liquid supply bottles 30, 32, 34, 36 and 38. By way of example, bottle 30 may contain a supply of clear carrier liquid, bottle 32 may contain black developer liquid comprising the carrier liquid and black pigmented toner particles. The other three bottles, 34, 36 and 38, may contain developer liquids of other colors, each made up of the carrier liquid and differently pigmented toner particles.

In the course of making a copy on the machine 10, as is known in the art, an original to be copied is placed face down on the platen below the cover 22. A scanning system focuses an image of this original on a rotating drum 40, the surface of which carries photoconductive material, thus to provide an electrostatic latent image on the surface of the drum 40. Next, in a manner to be described more fully hereinbelow, developer liquid from one of the bottles 32, 34, 36 or 38, is applied to the latent image to cause it to be developed by electrophoresis. After the image has thus been developed, a sheet of copy material, such for example as plain paper, is carried from one of the supplies into contacting or closely proximate relationship to the surface of the drum and the developed image is transferred to the paper. When this has been done, the finished copy is passed out to the delivery tray 24.

Referring now to FIGS. 3 to 6, each of these supply bottles 30, 32, 34, 36 and 38, has an outlet pipe 42 to which liquid is pumped in a manner to be described and the return fitting 44 to which liquid is returned. Pipes 42 lead to respective passages in a block 46. Tubes 48 connect the liquid passages to respective inlets 50 of a distributor housing 52. Liquid thus supplied to the housing flows past a ball check valve 54 to the interior of the housing. This liquid is conducted by a distributor outlet tube 56 to a fitting 58, one outlet of which leads to a developer distributor pipe 60. A second outlet of the fitting 58 is connected by a tube 62 to the machine cleaning station indicated generally by the reference character 64.

The developer distributor 60 delivers developer liquid to the surface of the drum 40 just above a developer electrode assembly indicated generally by the reference character 66. The assembly 66 includes a mounting stud 68 by means of which the assembly 66 is supported. It will readily be appreciated that tube 56, fitting 58 and pipe 60 form first common conduit means for supplying liquid to the developer electrode assembly or applicator 66.

Assembly 66 includes a pair of end plates 70 and 72 which support a segmented development electrode made up of three electrode segments 74, 76 and 78. In the operative position of the assembly 66 a pair of feet 80 and 82 of the assembly ride on the hard anodized end portions 84 and 86 of the drum 40 to hold the electrode segments 74, 76 and 78 in closely spaced relationship to the surface of the drum 40.

Liquid developer fed to the surface of the drum 40 above the assembly 66 is retained by a plate 88 supported between the end plates 70 and 72. A second plate 90 of the assembly 66 directs liquid coming out of the space between plate 88 and the surface of the drum, back toward the drum. As is more fully described in the copending application of Landa et al Ser. No. 628,389, filed July 6, 1984 for Electrophotographic Copier with Readily Removable Drum and Improved Drive System Therefor, a pivotal connection 92 indicated schematically in FIG. 3, supports the assembly 66 for swinging movement toward and away from the drum. In the operative position of the assembly, feet 78 and 80 are lightly biased into engagement with the end portions 84 and 86 of the drum.

The machine with which our liquid developer system is used, includes a "reverse" roller 94, positioned in closely spaced relationship to the surface of the drum 40. The roller 94 is driven with its surface moving in the direction opposite to that of the drum 40 at the point of adjacency to remove excess developer liquid from the surface of the drum. Such a roller is more fully shown and described in Hayashi et al U.S. Pat. No. 3,907,423.

Liquid from the developing station is caught in a tray 96 and in a return channel 98, the bottom of which inclines downwardly toward the rear of the machine. It will be appreciated that tray 96 and return channel 98 form second common conduit means for collecting liquid fed to the assembly 66 by the distributor pipe 60.

A cleaner assembly support bar 100 is supported for pivotal movement around an axis parallel to the axis of rotation of the drum 40. Bar 100 carries a bracket 102 which supports the cleaner blade 104. The cleaner roll 106 which is formed from soft closed cell material is carried by a shaft 108. Roller 106 is supported for limited movement in a direction perpendicular to the axis of shaft 108 between a position at which it is out of contact with the drum 40 and a position at which it is squeezed into engagement with the surface of the drum. As is pointed out more fully in the Landa et al application referred to hereinabove, the roller 106 normally is biased to its position at which it is out of engagement with the surface of the drum. Bracket 102 also carries a squeeze plate 110 which forms one wall of a cleaning liquid reservoir 112. Wall 110 is formed with one or more openings 114 through which liquid from the reservoir falls onto the surface of the cleaning roll 106. Reservoir 112 receives cleaning liquid from the tube 62.

As is more fully described in the Landa et al application referred to hereinabove, shaft 100 normally is so positioned that blade 104 is out of engagement with the drum surface and the cleaning roll 106 is biased out of engagement with the drum surface. When the cleaning system is to be brought into operation, shaft 100 is rotated in a clockwise direction as viewed in FIG. 3 to bring blade 104 into engagement with the drum surface. At the same time, squeeze plate 110 is moved into engagement with the cleaning roll 106 and forces the cleaning roll down against the surface of the drum. Drum 106 is rotated in the same direction as the direction of rotation of the drum and at such a speed as to cause the cleaning roller to exert a scrubbing action on the surface of the drum. As the roller moves into engagement with the squeeze plate 110, liquid is squeezed out of the roller. As the roller moves away from the squeeze plate 110, fresh liquid from the reservoir 112 moves into the expanding surface cells of the roller 106.

Liquid squeezed out of the roller 106 is caught by a trough 116, the bottom of which is inclined toward the front of the machine to provide a return channel 118 leading to a fitting 120 connected to a return line 122.

Both the return trough 98 and the tube 122 deliver returning liquid to the return manifold assembly indicated generally by the reference character 124 which may be formed as an integral member with the block 46.

Manifold 124 is formed with an opening 126 through which the return liquid from trough 98 and from tube 122 flow into a space 128. The bottom of the space 128 is provided with a plurality of openings 130 corresponding in number to the number of liquid supply bottles. These openings 130 lead into respective passages 132 formed in the block 46.

O-rings around the openings 130 form seats for all valves 134 carried by rods 136 which pass through a guide plate 138 and which are secured to the respective armatures 140 of a plurality of solenoids 142. Return pipes 144 connect respective passages 132 to the return fittings 44 of the liquid supply bottles.

Figure 5:
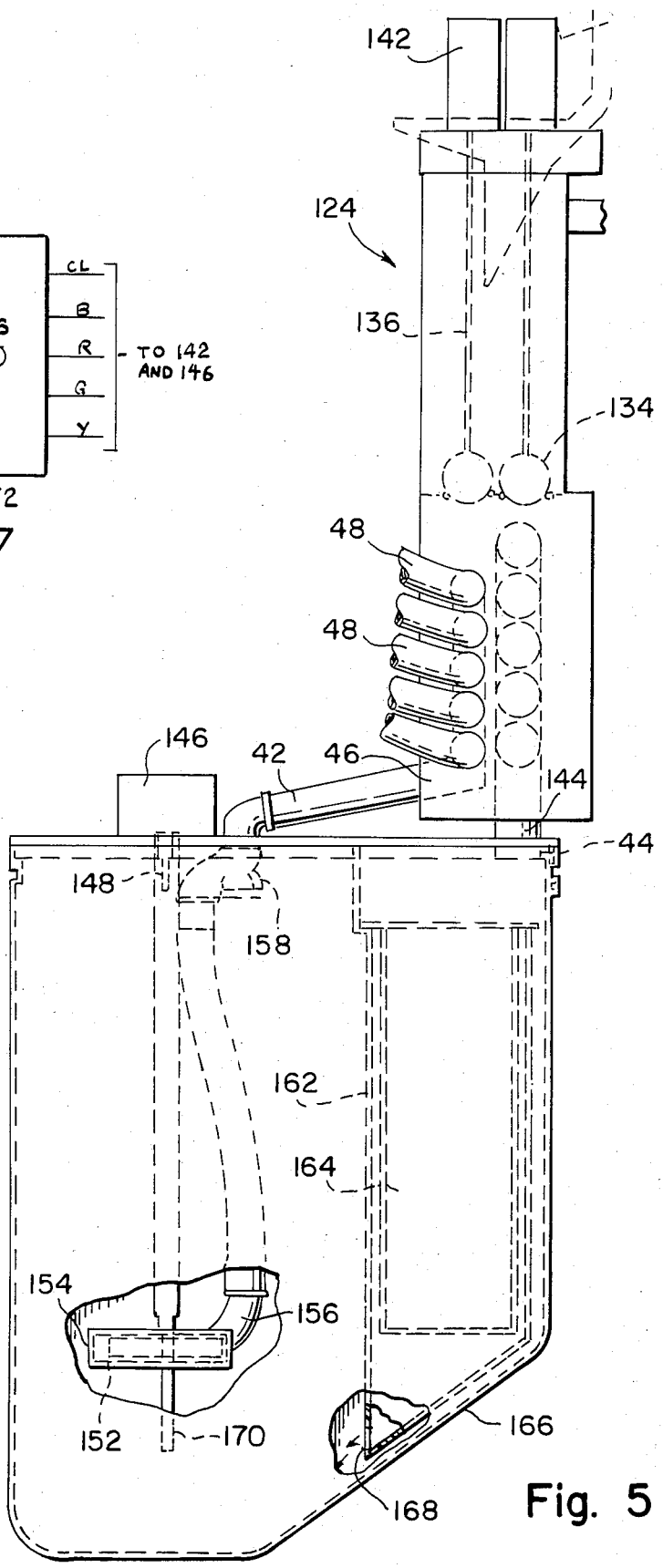
FIG. 5 is a front elevation of a further portion of the liquid distribution system of our multisource liquid developer electrophotographic copier.
Figure 6:
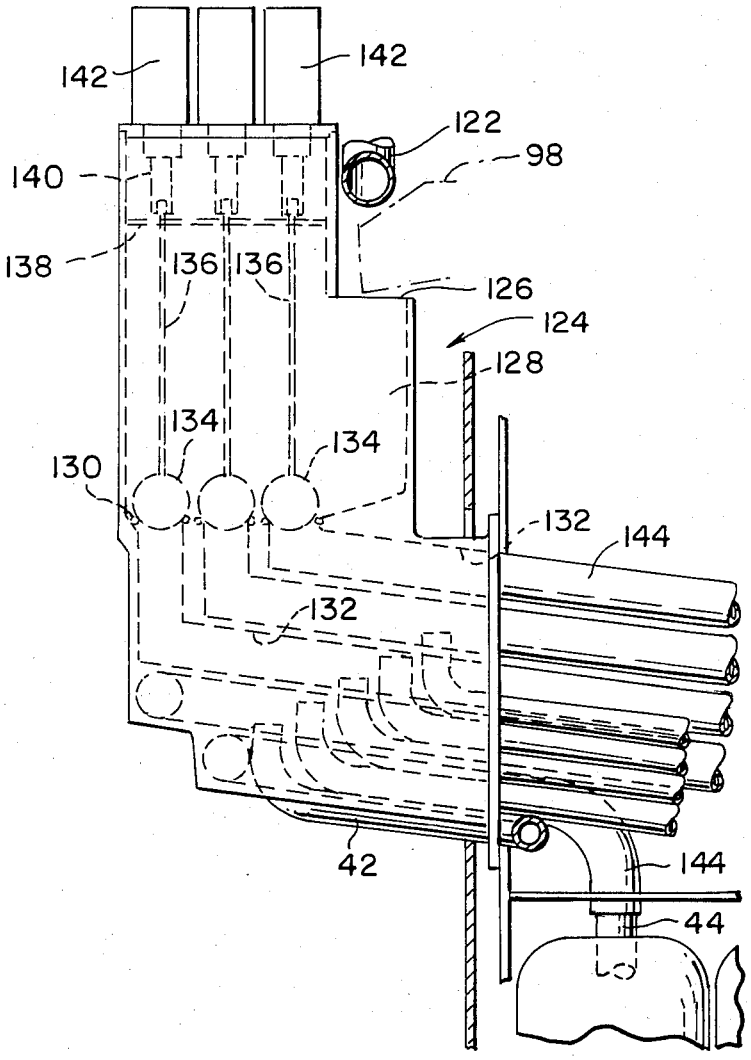
FIG. 6 is a fragmentary side elevation of the portion of the liquid distribution system illustrated in FIG. 5.

Referring to FIG. 5, each of the liquid supply bottles 30, 32, 34, 36 and 38 is provided with an individual pump motor 146, the shaft 148 of which is connected by an elongated shaft 150 to the impeller 152 of a pump 154 located adjacent to the bottom of the bottle. Impeller 152 drives liquid outwardly to a tube 156 up to a coupling 158 connected to one of the pipes 42 leading to the block 46.

Liquid returned to any one of the bottles is directed by the return fitting 44 to the interior of a filter housing 162 and through a filter 164 located within the housing. We form the bottom of the filter housing so as to be parallel to an inwardly inclined tank bottom portion 166. Returning liquid is discharged through an opening 168 adjacent to the bottom of the tank. In this way, not only is the space within the tank bottom in which toner particles may settle greatly reduced, but also the returning liquid is directed toward this reduced bottom portion so as to agitate these toner particles. We also form the impeller shaft with an extension 170 to receive an agitator if such should be found necessary or desirable.

Figure 7:
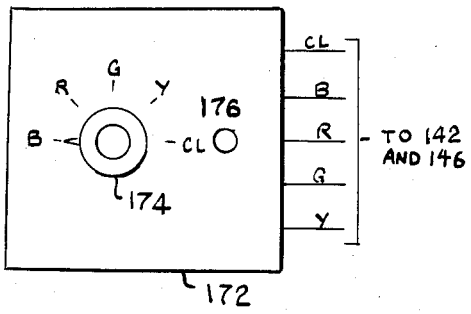
FIG. 7 is a schematic view of one form of control system for our copier.

Referring to FIG. 7, our machine includes a control system 172 having a dial or the like 174 adapted to be set to determine which working solution is fed to the operating parts of the machine. Once the liquid has been selected, a pushbutton 176 is actuated to cause one or more copies to be made. It is to be understood that this showing is by way of example only. The machine may be provided with black developer which normally is used to make copies. Then, in other positions of the dial 174, for example, red or green or yellow may be selected. It may be desirable further to provide a setting "CL" indicating "clear" for flushing the machine with clear carrier liquid. In any event for the usual machine operation dial 174 will be set to B so that the solenoid 142 corresponding to the black liquid is energized so that black developer flows through the system. When it is desired to print with a different color, the dial 174 can be moved to, for example, "R" indicating Red. When this is done the circuit 172 first puts out a signal on the "CL" line to flush the common parts of the system including the cleaning system 64, the development electrode system 66, and the return channels 118 and 98. After the flushing liquid has passed through the system for a predetermined period of time, the "ready" signal will be given and the machine operator can actuate the button 176 to make a copy. It may be desirable at the end of making a copy with this color that the system again be flushed. This can readily be accomplished by the control system 172 in a manner known to the art.

Working solution which has been fed to the machine in the course of a copy making operation is returned to the tank from whence it came through the return pipe 144. It enters the tank through the fitting 44 and passes into the filter housing 62 and through the filter 164. As it moves downwardly through the filter housing 162, it is contained until it reaches the opening 168 at the bottom thereof from whence it issues as indicated by the arrows in FIG. 5 in a stream directed downwardly toward the reduced area bottom of the tank to agitate the developer liquid therein to inhibit sedimentation in the bottom of the tank.

It will be seen that we have accomplished the objects of our invention. We have provided an electrophotographic copier which selectively prints in one of a number of colors. Our copier accomplishes this result without contaminating one color with another. Our system is simple in construction and certain in operation. We have provided a developer tank which inhibits settling of toner particles in the processing liquid.

We claim:

1. A copying machine including in combination means for providing a surface for receiving an electrostatic latent image, a developer applicator for applying liquid developer to said image, a plurality of supplies of liquid developer of different colors, first common conduit means for feeding liquid to said applicator, first feeding means for selectively feeding liquid from one of said supplies to said first common conduit means, second common conduit means for collecting from said surface liquid fed to said applicator by said first common conduit means, second feeding means for selectively feeding liquid from said second conduit means to the supply from whence it came, a supply of cleaning liquid, and third feeding means for feeding cleaning liquid from said cleaning liquid supply to said first common conduit means.

2. Apparatus as in claim 1 in which said applying means comprises an electrode assembly and means positioning said electrode assembly in closely spaced relationship to said surface.

3. Apparatus as in claim 2 which said surface providing means is a drum and in which said positioning means comprises means on said electrode assembly for engaging peripheral edge surface portions of said drum.

4. Apparatus as in claim 1 in which said surface providing means is a drum, said applying means comprising means forming a confined space at the surface of said drum and means for inhibiting flow of liquid from the edges of said space.

5. A copier as in claim 1 including means for removing excess liquid applied to said surface by said applying means, said feeding means including means for returning removed excess liquid to a selected supply.

6. A copier as in claim 1 in which said first feeding means comprises respective selectively energizable pumps for delivering liquid to said common conduit and said second feeding means comprises selectively energizable return valves for conducting liquid from said common conduit to said supplies.

7. A copier as in claim 1 in which each of said supplies comprises a liquid developer container, each of said containers having a cross-sectional area which gradually decreases from a location above the container bottom to the bottom, and means for directing returning liquid toward the bottom of said container.

8. A copying machine as in claim 1 including a cleaning unit and means for feeding said liquid to said cleaning unit and back to the selected supply.

9. A copying machine as in claim 8 including mans for actuating said third feeding means prior to the operation of said first feeding means.

10. Apparatus as in claim 1 including means for actuating said third feeding means prior to the operation of said first feeding means.

* * * * *

UNITED STATES PATENT AND TRADEMARK OFFICE

CERTIFICATE OF CORRECTION

PATENT NO. : 4,627,705

DATED : December 9, 1986

INVENTOR(S) : Benzion Landa and Josef Rosen

It is certified that error appears in the above-identified patent and that said Letters Patent are hereby corrected as shown below:

Column 6, line 16 - after "2" insert -- in --.

Column 6, line 45 - "mans" should read -- means --.

Signed and Sealed this

Twenty-first Day of April, 1987

*Attest:*

DONALD J. QUIGG

*Attesting Officer*

*Commissioner of Patents and Trademarks*